US005988215A

United States Patent [19]

Martin et al.

[11] Patent Number: 5,988,215

[45] Date of Patent: Nov. 23, 1999

[54] FLUID CONTROL ASSEMBLY

[75] Inventors: David D. Martin, Dunbar; Douglas W. Ray, Irwin, both of Pa.

[73] Assignee: Robertshaw Controls Co., Richmond, Va.

[21] Appl. No.: 09/050,838

[22] Filed: Mar. 30, 1998

Related U.S. Application Data

[62] Division of application No. 08/561,579, Nov. 21, 1995.

[51] Int. Cl.[6] ..... F16K 31/126; F16K 27/12

[52] U.S. Cl. ..... 137/613; 137/505.41; 251/331

[58] Field of Search ..... 251/331, 61.1, 251/61.2, 61.4, 129.17; 137/505.41, 613

[56] References Cited

U.S. PATENT DOCUMENTS

| | | | |
|---|---|---|---|
| 1,897,517 | 2/1933 | Hughes . | |
| 3,180,356 | 4/1965 | Galley . | |
| 3,405,869 | 10/1968 | Grayson et al. . | |
| 3,433,262 | 3/1969 | Ray | 137/505.41 X |
| 3,648,727 | 3/1972 | Huyck . | |
| 3,857,407 | 12/1974 | Olson . | |
| 4,089,319 | 5/1978 | Tamada et al. . | |
| 4,104,016 | 8/1978 | Baysinger . | |
| 4,298,336 | 11/1981 | Riehl . | |
| 4,304,260 | 12/1981 | Turner et al. | 137/613 |
| 4,354,633 | 10/1982 | Turner et al. . | |
| 4,501,290 | 2/1985 | Sturman et al. . | |
| 4,749,005 | 6/1988 | Bergquist . | |

FOREIGN PATENT DOCUMENTS

| | | |
|---|---|---|
| 58-060123 | 4/1983 | Japan . |
| 58-075617 | 5/1983 | Japan . |
| 62-294807 | 12/1987 | Japan . |
| 63-140219 | 11/1988 | Japan . |

*Primary Examiner*—Kevin Lee
*Attorney, Agent, or Firm*—Fulbright & Jaworski L.L.P.

[57] ABSTRACT

A fluid control assembly that includes fluid valving, fluid regulation, automatic safety shut-off valving and manual shut-off valving in one assembly, a novel fluid control unit that integrates the above functions in one unit, and a novel ignitor and a novel seal and diaphragm for use in the assembly.

12 Claims, 9 Drawing Sheets

FLUID CONTROL ASSEMBLY

CROSS-REFERENCE TO RELATED APPLICATIONS

This application is a divisional of application Ser. No. 08/561,579, filed Nov. 21, 1995, pending, and incorporated by reference herein for all purposes.

BACKGROUND OF THE INVENTION

The present invention relates to a novel fluid control assembly that integrates numerous functions, including fluid pressure regulation, fluid valving, safety shut-off valving and manual shut-off valving, into one assembly and to a novel fluid control unit, a novel sealing diaphragm member and a novel ignitor utilized as integral parts of the fluid control assembly.

Conventional fluid control assemblies are used in a number of applications, including fuel burning devices, such as ranges, laundry equipment and heaters, and fluid dispensing devices, such as vending machines. In such applications, an assembly performs a number of separate and distinct functions. For example, in a conventional gas range, the assembly must regulate the pressure of the gas supplied to the oven burners and to the top burners. The assembly must also have a means of controlling gas flow to the burners as desired. In addition, the assembly must include means for shutting off fluid to the burner assembly(ies), for example, in the event of loss of ignition means. This function is often referred to as a safety shut-off. Also, an assembly of this type includes a manual shut-off which is operated, for example, for repair purposes or if the assembly will not be used for an extended period of time.

Conventional gas control assemblies achieve these various functions by the inclusion of a number of interconnected discrete subassemblies. Such assemblies require numerous parts, which the manufacturer of such assemblies must buy individually and assemble and interconnect in a time- and labor-intensive manner. In addition to the above shortcoming, such interconnection increases the possibility of leakage in piping between the subassemblies or at the connections. Furthermore, the manufacturer must carefully control the assembly process since it is subject to assembly error.

Among the various subassemblies that comprise any gas-burning device, significant subassemblies include the gas regulation subassembly, the gas valving subassembly, the safety shutoff valve subassembly and the manual shutoff valve subassembly. Each subassembly performs a separate and important function. Particularly, the gas regulating subassembly regulates the pressure of the externally-supplied gas. The pressure of such gas is known to vary due to a number of factors that affect the particular gas delivery system. Accordingly, the gas supplied to the burner subassembly(ies) must be regulated to assure an established and constant pressure. Once regulated, the gas is valved to allow desired gas flow to the burner assembly(ies) to assure that a targeted temperature level or heat level is maintained.

Current gas-burning devices must also include a separate safety shutoff valving capability. This capability insures that the flow of gas will be discontinued if the source of ignition to the burner is lost.

Additionally, conventional gas-burning devices include a manual shut-off valve that allows a person to manually shut-off gas flow to the entire system, e.g., in the case of repair or extended non-use of the device.

Given the complexity and detail involved in purchasing and assembling these many parts and subassemblies and the increased risk of leakage from the various interconnections, manufacturers of gas-burning devices desire that these parts and subassemblies be integrated into one unit.

SUMMARY OF THE INVENTION

It is, therefore, an object of the present invention to provide a fuel control assembly that integrates a number of traditionally discrete functions.

Another object of the invention is to provide a fuel control assembly that includes an integrated fuel control unit that provides fuel pressure regulation, manual shutoff valving, safety shut-off valving and fuel operational valving.

Yet another object of the present invention is to provide a fuel control assembly that reduces the duplication of similarly functioning parts.

A further object of the present invention is to provide a fuel control assembly that reduces the time and labor requirements for manufacture.

A still further object of the present invention is to provide a fuel control assembly that reduces the interconnections between subassemblies and the attendant possibility of leakage.

Thus, in accordance with one aspect of the present invention, there is provided a fluid control assembly, comprising a fluid inlet; means for providing at least one operational condition to the assembly; an integral fluid control unit that includes means for regulating the fluid pressure, means for fluid valving responsive to the operational condition, and means for manually shutting off fluid flow; means for operatively opening and closing the valving means; and a fluid outlet. Preferably, the regulating means includes a regulating chamber, a diaphragm member operatively positioned adjacent to the chamber, a regulator stem and a regulator seat. In a particularly preferred embodiment, one end of said regulator stem includes a ball member and the other end of the stem is connected to the diaphragm.

Preferably, the diaphragm member comprises a diaphragm area, a sealing area for sealing the integral unit against fluid leakage and a valving area, wherein the diaphragm member in the valving area comprises dual valve disks and a valve sealing web. Specifically, the diaphragm member comprises a flexible sheet, a back-up plate and a stiffener plate, the stiffener plate being positioned adjacent the flexible sheet in the area of the regulating chamber.

With respect to additional preferred embodiments, the means for operatively opening and closing the valving means is either a mechanical means, a pneumatic means or an electrical means and, preferably, is an electrical means. Most preferably the means is an electrical solenoid.

In accordance with additionally preferred embodiments, the fluid control assembly further comprises a first internal passageway in communication at one end with the fluid inlet and at the other end with a pressure regulating chamber; a second internal passageway, wherein one end of the second passageway is in communication with the pressure regulating chamber and the other end of the second internal passageway is in communication with at least the valving means; and a third internal passageway, wherein one end of the third internal passageway is in communication with the valving means and the other end of the third passageway is in communication with the fluid outlet. In addition, the fluid control assembly also preferably includes at least one burner assembly, at least one ignitor means and a spark module in electrical communication with the ignitor means. Also, preferably, the fluid control assembly further comprises a fluid outlet line, wherein one end of the line is in communication with the fluid outlet and the other end of the line is in communication with the burner assembly. In addition to the above-recited preferred components, the fluid control assembly further comprising a control means for controlling the means for operatively opening and closing the valving means and the ignitor means.

The present fluid control assembly finds particular applicability in a gas oven and range.

In accordance with another aspect of the present invention, there is provided a fluid control unit, comprising a body which includes a multiplicity of fluid passageways, a fluid inlet, a regulating chamber, at least one valve seat and a fluid outlet; an integral diaphragm and seal member which includes a diaphragm area, a valving area and a fluid sealing area, wherein the member is positioned in operative engagement with the body; a cover positioned on the side of the integral diaphragm and seal member opposite the cover, the body, the integral diaphragm and seal member, and the cover being joined together to form an operative unit; means for positioning the diaphragm area of the integral member in relation to the regulating chamber to regulate fluid pressure; and means for engaging and disengaging the valving area of the integral member with the valve seat of the body.

In accordance with still yet another object of the present invention, there is provided an integral seal and diaphragm that includes a flexible sheet, a support plate having a rigidity greater than the flexible sheet, and a means for sealing the seal and diaphragm against fluid leakage.

In accordance with yet another aspect of the present invention, there is provided an ignitor that includes an electrode, a spark trap positioned about the electrode and preferably having an L-shape, a terminal structure positioned at one end of the electrode, and means for inducing a spark between the electrode and the terminal structure.

Other and further objects, features and advantages will be apparent from the following description of presently preferred embodiments of the invention, given for the purpose of disclosure and taken in conjunction with the accompanying drawings.

DETAILED DESCRIPTION OF PREFERRED EMBODIMENTS

Figure 1:
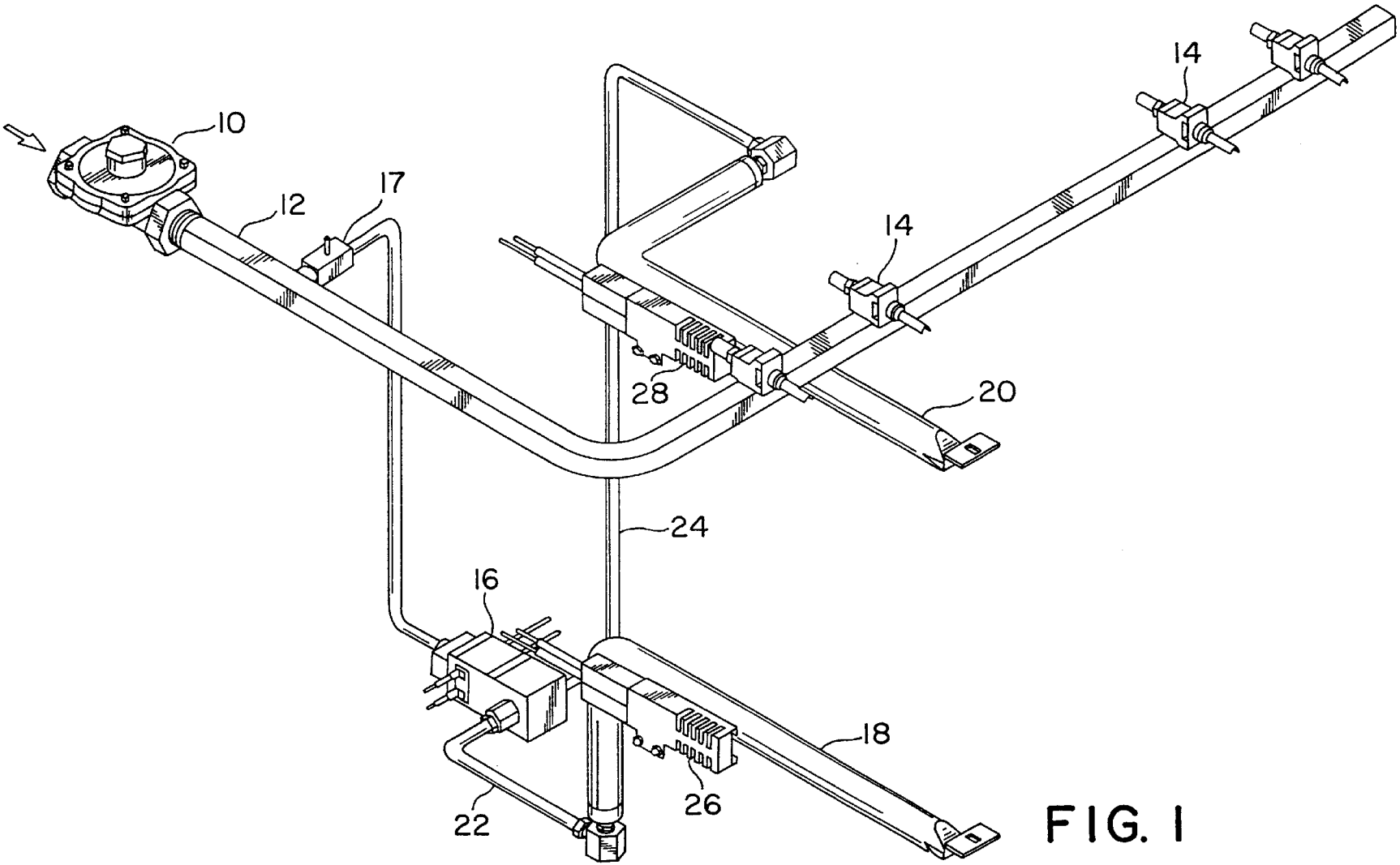
FIG. 1 is a perspective view of a prior art gas control assembly.

Currently available constructions for fluid control assemblies typically include a fluid pressure regulating mechanism, a separate fluid valving mechanism or mechanisms, a manual shut-off mechanism and a further separate safety shut-off valve. A common fluid control device is a gas oven and range assembly. A typical gas oven and range assembly is shown in FIG. 1. A fuel gas is provided to the assembly from an outside source. The gas passes through and is regulated by gas regulator 10. The regulated gas then passes into and through manifold 12 to various valving means. As depicted in FIG. 1, these valving means include range top valves 14 and oven burner valve 16. The regulated gas is fed, upon demand, from the manifold 12 into the oven burner and range burner assemblies. With respect to the oven burner assemblies, FIG. 1 illustrates an oven assembly that includes both an oven bake burner assembly 18 and an oven broil burner assembly 20. Depending upon the gas demand requirements of the oven, the regulated gas passes through the valve 16 and into and through either oven bake burner supply tube 22 or oven broil burner supply tube 24. A manual shut-off valve 17 is positioned upstream of valve 16 for shutting-off gas flow to the oven cavity, as required. The gas control assembly of FIG. 1 also includes hot surface ignitors 26 and 28. These ignitors serve to ignite gas supplied to the respective burner assemblies 18 and 20. A thermostat bulb 30 (not shown) is also included in the oven cavity to sense oven cavity temperature. When the oven thermostat senses temperature below the set temperature, electrical energy is supplied to the hot surface ignitor corresponding to the selected bake or broil burner assembly through oven valve 16. This energy flow causes the ignitor to reach ignition temperature of the fuel gas and causes valve 16 to convey gas to the particular burner assembly 18 or 20. In the event of failure of a hot surface ignitor, electrical energy will cease to flow through it and consequently will fail to flow through oven valve 16. Thus, oven valve 16 will cease to supply gas to the respective oven burner assembly. This cooperative relationship between the hot surface ignitors and valve provides the assembly with safety valve shut-off functioning.

As is quickly apparent, this conventional oven and range control assembly and other similar fluid control assemblies comprise numerous components and substantial piping. Typically, the manufacturer purchases these components individually or in subassemblies and then assembles them into the final gas control assembly.

In stark contrast to these conventional constructions, the fluid control assembly of the present invention integrates a number of these subassemblies into one unit. Specifically, the unit regulates the pressure of the inlet fluid, distributes the pressure-regulated fluid to integral valving means, valves the regulated fluid, upon demand, to specified burner assemblies, manually shuts-off fluid flow for repair and safety purposes, and automatically shuts-off fluid flow as required by operating conditions. The fluid control assembly has particular applicability to gas control devices and, particularly, to gas ranges.

Figure 2:
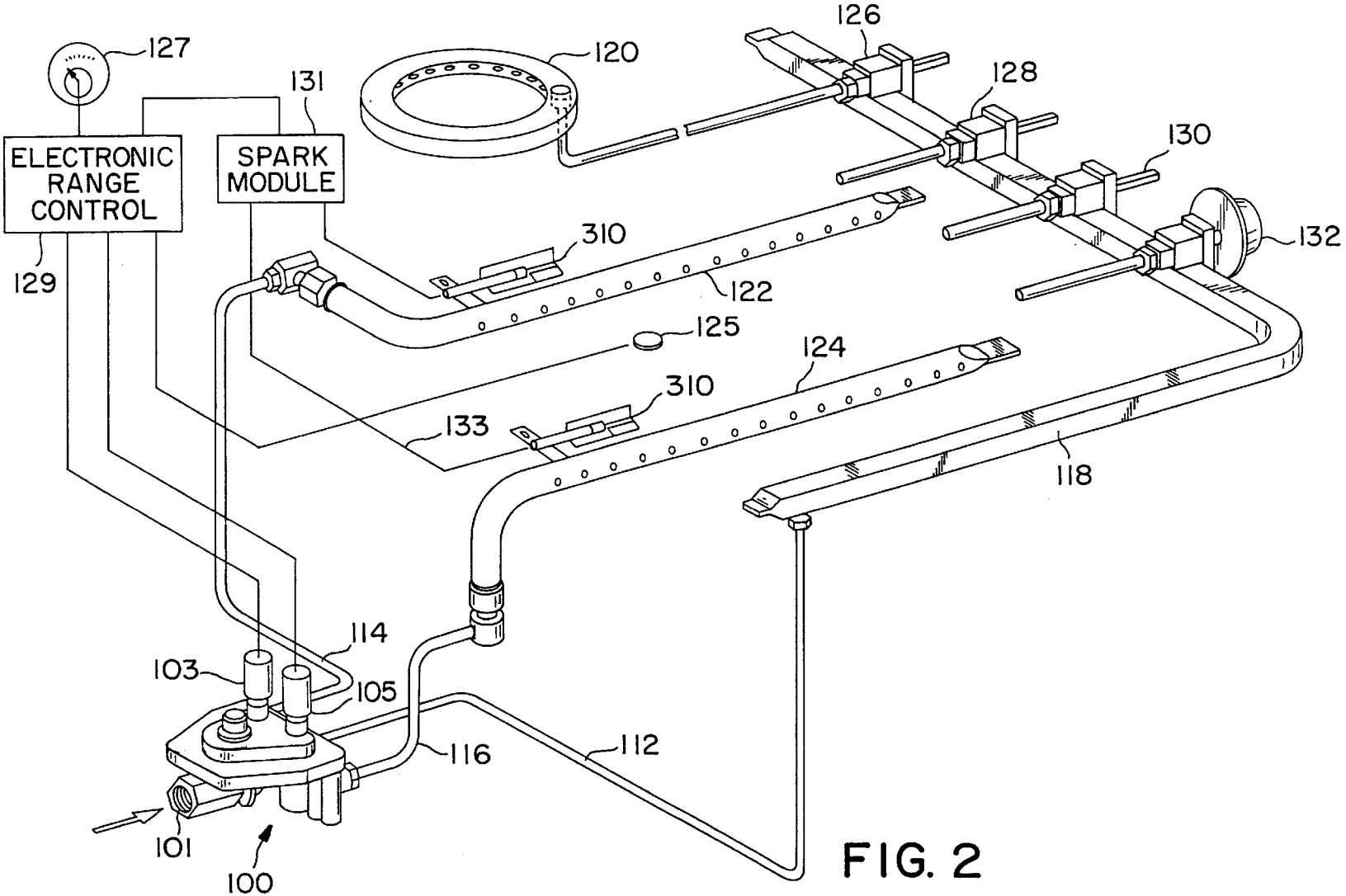
FIG. 2 is a perspective view of a fuel control assembly according to the present invention.

FIG. 2 illustrates a preferred embodiment of the present invention and, particularly, a gas range assembly that includes the novel integral gas control unit. It is noted, however, that the novel integral fluid control unit illustrated in FIG. 2 and the other figures is applicable in any fluid control application in which the functions of pressure regulation, fluid valving, manual shut-off valving and automatic safety valving or any combination thereof are required. Referring specifically to FIG. 2, the gas control assembly includes gas control unit 100. It includes gas inlet 101 which receives fuel gas supplied from an external supply line (not shown). It also includes valving assemblies 103, 105 for controlling the rate of regulated gas flow. The unit 100 then distributes the gas to the various burner assemblies of the device through a number of gas outlet lines 112, 114 and 116.

As will be discussed in more detail below, the number of gas outlets depends upon the number and type of burner assemblies utilized by the range. For example, FIG. 2 illustrates a multiple range burner and dual oven burner construction. Gas outlet 112 provides gas via manifold 118 to a range top burner assemblies. Gas outlet lines 114 and 116 provide gas to oven burner assemblies 122 and 124, respectively, for example, gas outlet 114 to an oven broil burner assembly 122 and gas outlet 116 to an oven bake burner assembly 124. The gas control assembly, as shown in FIG. 2, also includes range burner valves 126, 128, 130 and 132 for regulating gas flow from the gas manifold 118 to the respective burner assembly(ies). For the sake of simplicity, only one range burner assembly and one control knob for the burner valve are shown.

The valving mechanisms 103 and 105 control the gas flow to the oven burner assemblies 122 and 124, respectively. The assembly also includes spark ignitors 310 for igniting gas supplied to the respective burner assembly. Also included is a temperature sensor 125 for measuring oven cavity temperature, an input mechanism 127 for selecting between bake and broil operation and for setting desired oven cavity temperature, an electronic range control 129 for providing electrical energy to the system depending on operational conditions and a spark module 131 for providing high voltage electrical energy via terminal wire 133 to the spark ignitors.

Figure 3:
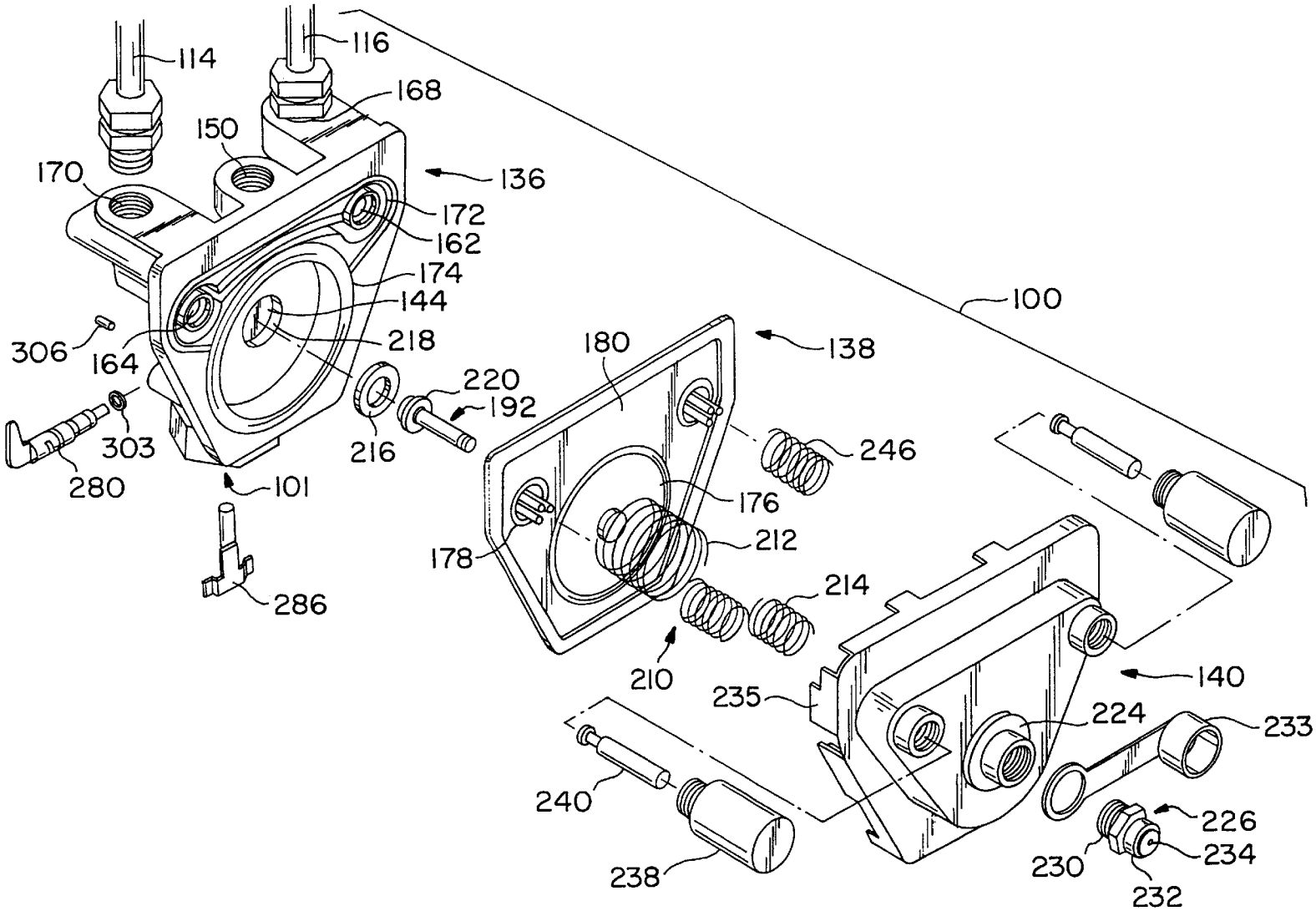
FIG. 3 is an exploded perspective view of the gas control unit of the present invention.
Figure 4:
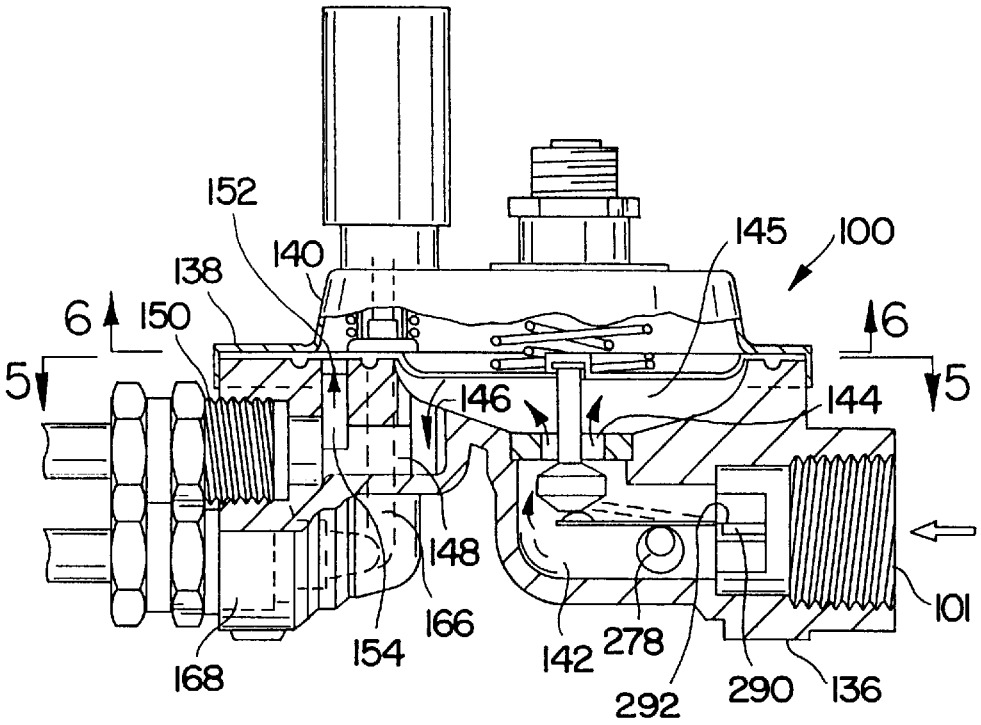
FIG. 4 is a longitudinal cross-sectional view of the gas control unit of the present invention taken along lines 4—4 of FIG. 12.
Figure 5:
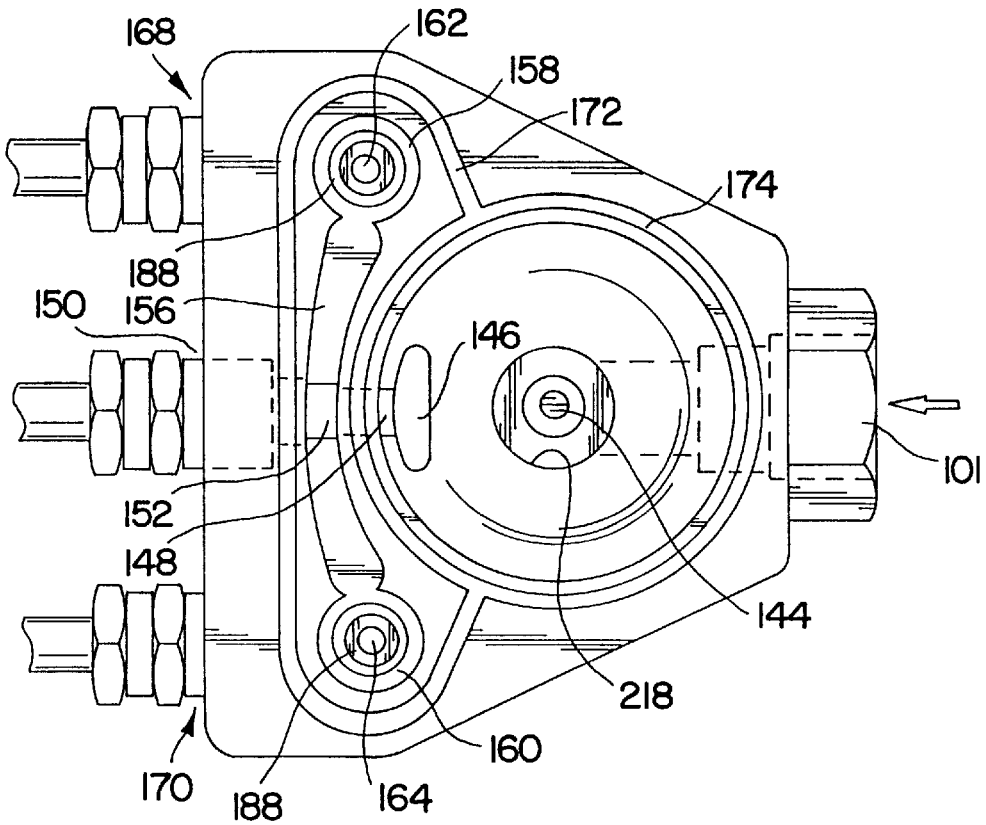
FIG. 5 is a top plan view of the present gas control unit body illustrating the various passageways and sealing channels thereof taken along lines 5—5 of FIG. 4.

Turning now to FIGS. 3, 4 and 5, the novel gas control unit 100 is depicted in exploded, cross-sectional and top plan views, respectively, to illustrate the detail of the unit. The gas control unit 100 includes a body 136, an integral diaphragm and seal 138, and a cover 140.

The body 136 includes the previously noted gas inlet 101. As more particularly shown in FIG. 4, the gas inlet is connected by a passageway 142 to opening 144. The opening 144 opens into regulating chamber 145. The body 136 also includes an opening 146 that is connected by a passageway 148 that leads from opening 146 to gas outlet 150 and to passageway 154. Passageway 154, in turn, leads to opening 152. Referring to FIG. 5, opening 152 opens into a channel 156 which extends in opposite directions from opening 152 and forms circular chambers 158 and 160 at either end of channel 156. Positioned within and separate from circular chambers 158 and 160 are openings 162 and 164, respectively. The opening 162 is connected via passageway 166 to gas outlet 168 (see FIG. 4). Though not shown by FIG. 4, opening 164 is connected by a similar passageway to gas outlet 170.

Referring to FIG. 5, the body also includes grooves 172 and 174. The grooves are dimensioned so as to receive a mating portion of the integral diaphragm and seal 138 in a manner to be described in more detail below.

Thus, as can be seen, the body 136 comprises the openings and passageways for the flow of gas. As the following discussion will illustrate, the integral diaphragm and seal 138 cooperates with the body to control the gas flow. The cover 140, in turn, cooperates with the integral diaphragm and seal to seal the fluid within the body. In addition, the cover provides support to a variety of functional components, including energy supply means, valving means and regulating means.

Figure 6:
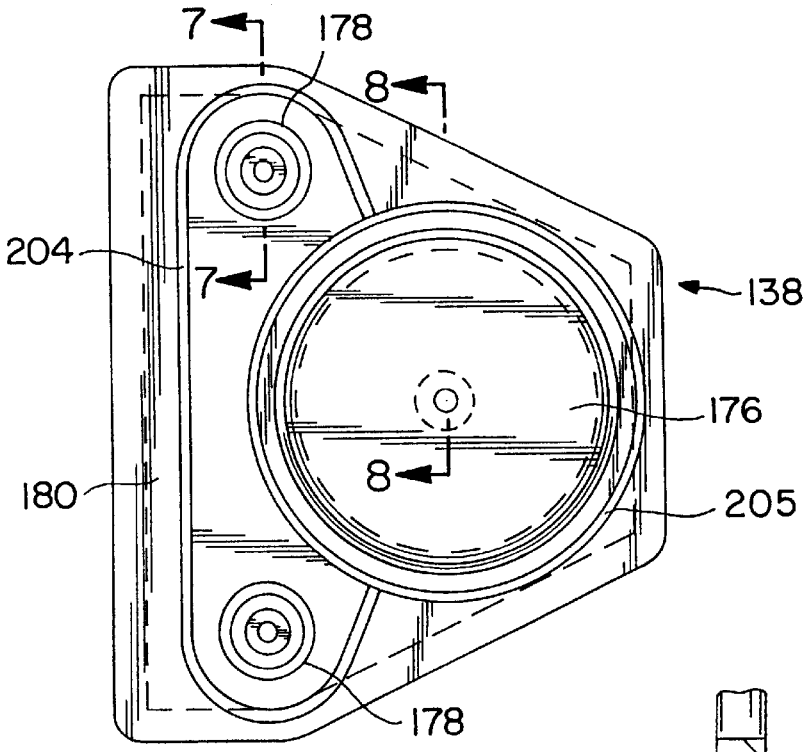
FIG. 6 is a bottom plan view of the integral diaphragm and seal of the present invention taken along lines 6—6 of FIG. 4.

Turning now to the integral diaphragm/sealing member 138 and referring to FIG. 6, the member 138 comprises three distinct functional areas, i.e., a diaphragm area 176, valving areas 178, and a sealing area 180. The diaphragm area 176 serves to regulate the pressure of the unregulated externally supplied gas. The valve areas 178 are designed to valve the regulated gas flow to the range and oven burners according to operational conditions. Finally, the sealing area 180 seals the unit against gas leaks. The member 138 achieves this latter sealing function without the inclusion of a separate gasket or sealing medium.

Figure 7:
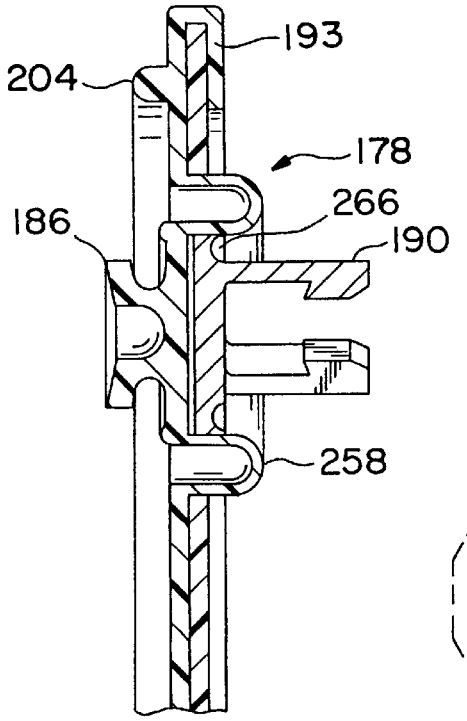
FIG. 7 is a partial cross-sectional view of the integral diaphragm and seal taken along lines 7—7 of FIG. 6, and particularly the construction of the valve means of the integral diaphragm and seal.
Figure 8:
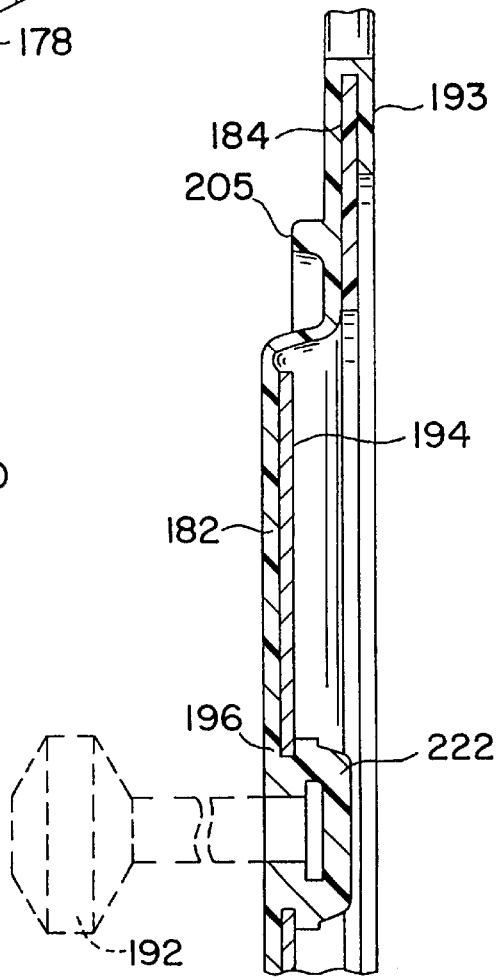
FIG. 8 is a partial cross-sectional view of the integral diaphragm and seal taken along lines 8—8 of FIG. 6, and particularly the construction of the regulator stem means of the integral diaphragm and seal.

As shown in FIG. 8, the member 138 is formed from a flexible sheet 182. A back plate 184 is positioned on the side of the flexible sheet 182 opposite the body 136. The flexible sheet comprises a variety of profiles along its length depending upon the function to be performed. For example, FIG. 7 illustrates the sheet's cross-sectional profile in the valve area 178 wherein it forms a valve disk 186 which engages a valve seat 188, as generally identified in FIG. 5. The sheet 182, in the valve area 178, is also formed to receive a valve carrier 190. The valve carrier may receive an actuator that, in combination with the valve carrier, enables movement of the valve area 178, and particularly valve disk 186, in relation to the valve seat 188 to open and close the valve and thus allow or prevent passage of regulated gas to the oven burners.

Referring to FIG. 8, the integral diaphragm and seal profile in the diaphragm area 176 is shown. The flexible sheet 182 is formed so as to receive regulator stem 192. The diaphragm area 176 of the integral diaphragm and seal also includes a stiffener plate 194. The plate 194 has an opening 196 through which the flexible sheet extends in that area in which the regulator stem 192 is received. The stiffener plate limits the deflection of the flexible sheet in the diaphragm area to provide more defined control of gas regulation.

As illustrated in both FIGS. 7 and 8, the flexible sheet extends about both sides of the back plate around the perimeter of the back plate as generally referred to at 193. When assembled, the portion 193 will be compressed between the body 136 and cover 140 and, thus, will maintain a force load on the body and cover, resulting in a secure assembly.

Figure 9:
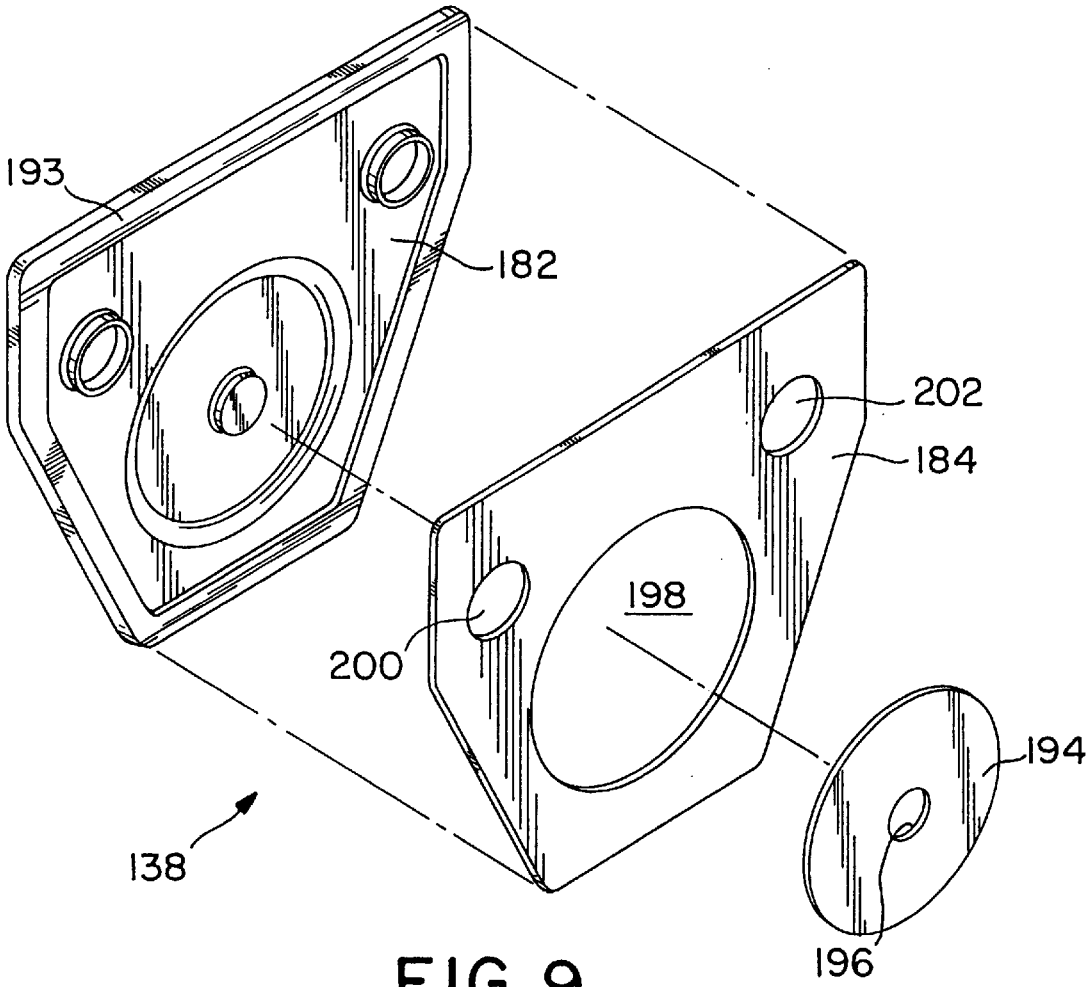
FIG. 9 is an exploded perspective view of the back plate of the combination diaphragm and seal.

Referring to FIG. 9, the integral diaphragm and seal 138 is shown in more detail in an exploded perspective view. Particularly, the back plate 184 has an opening 198 defining the outer diameter of the diaphragm area 176. As such and among various other advantages, the provision of the back plate in the manner illustrated, allows for the exact definition of the operative diaphragm area for more-controlled gas regulation. The back plate further includes openings 200 and 202. The openings 200, 202 conform to the flexible sheet in the valve area 178, as illustrated in FIG. 7. As is the case in the diaphragm area, the back plate, due to its rigid construction, only allows movement of the valve means in the intended areas. More particularly, because the back plate can be more precisely controlled, the dimensions of the movable portions of the flexible sheet may be more precisely controlled. In the prior art structures, dimensions of the movable portions were affected by the as-cast dimensions of interacting parts.

Referring again to FIG. 6, the side of the integral diaphragm and seal member 138 contiguous to the body 136 is shown. The member 138 includes raised portions 204 and 205. The raised portions 204, 205 are configured so as to fit closely into the respective grooves 172 and 174 of the body. Upon assembly, the mating of the raised portion and grooves prevents fluid leaks without the inclusion of a separate gasket or sealing medium. When the raised portion is assembled into the mating groove, it will accurately align the integral diaphragm and seal member and any attached parts with the mating parts, as will be more specifically described below.

Turning again to FIG. 3, the gas control unit 100 also includes a gas pressure regulating assembly 210. The assembly includes springs 212 and 214, regulator stem 192 and regulator seat 216. As assembled, the seat 216 is positioned by and retained within an offset pocket 218 in body 136, as may be easily seen in FIG. 5. The regulator stem 192 terminates at one end in a ball member 220. As assembled, the regulator stem 192 extends through the seat 216 so that the stem ball 220 is positioned on the body-side of the seat 216 and the opposite end of the stem engages and is retained by the membrane 138 (see FIG. 4). As previously discussed, the opposite end of the regulator stem 192 is retained in the diaphragm area by the flexible sheet of the integral diaphragm and seal (see FIG. 8).

The springs 212 and 214 are positioned on the cover-side of the membrane 138, i.e., on the side of the membrane opposite the regulator stem and seat. Though not illustrated, the stiffener plate 194 may include means for locating and retaining the springs 212 and 214.

The spring 212 is provided to regulate gas pressure when natural gas is supplied to the unit. One end of the spring 212 acts against the membrane 138 in the diaphragm area 176 and the other end acts against the cover 140. The cover has an indentation 224 that receives and seats the spring 212. The regulator assembly 210 is dimensioned so as to load the spring 212 to a predetermined force so as to control the diaphragm movement and, thus, gas regulation.

The second spring 214 cooperates with spring 212 to provide an alternative pressure setting, if required by operating conditions. The spring 214, if required, is loaded by a regulator plug 226. The plug 226 is positioned within opening 228 in cover 140. The plug has opposing portions 230 and 232 having differing lengths. When the short portion of the plug is inserted into the opening 228, the spring 214 is not loaded. Conversely, when the long portion of the plug is inserted into the opening 228, the long portion abuts the end of spring 214 and the spring is loaded and a higher pressure is applied to the diaphragm. The plug and opening may be constructed in any manner which allows for sufficient retention of the plug by the cover.

The plug also has a vent 234 machined into it. The vent 234 allows venting of the unit as necessary to allow free movement of the diaphragm and to expel gas that seeps through the diaphragm, passes around the diaphragm or, in case of damage to the diaphragm, passes through any resulting opening in the diaphragm. Alternatively, an opening can be provided in the cover 140 to allow such venting. Also, the cover includes a cap 233. The cap is retained between the backside of the indentation 224 and the plug 226. The cap protects the vent opening from damage. Finally, the cover includes tabs 235 for aiding in the sealing of the unit upon final assembly.

Figure 10:
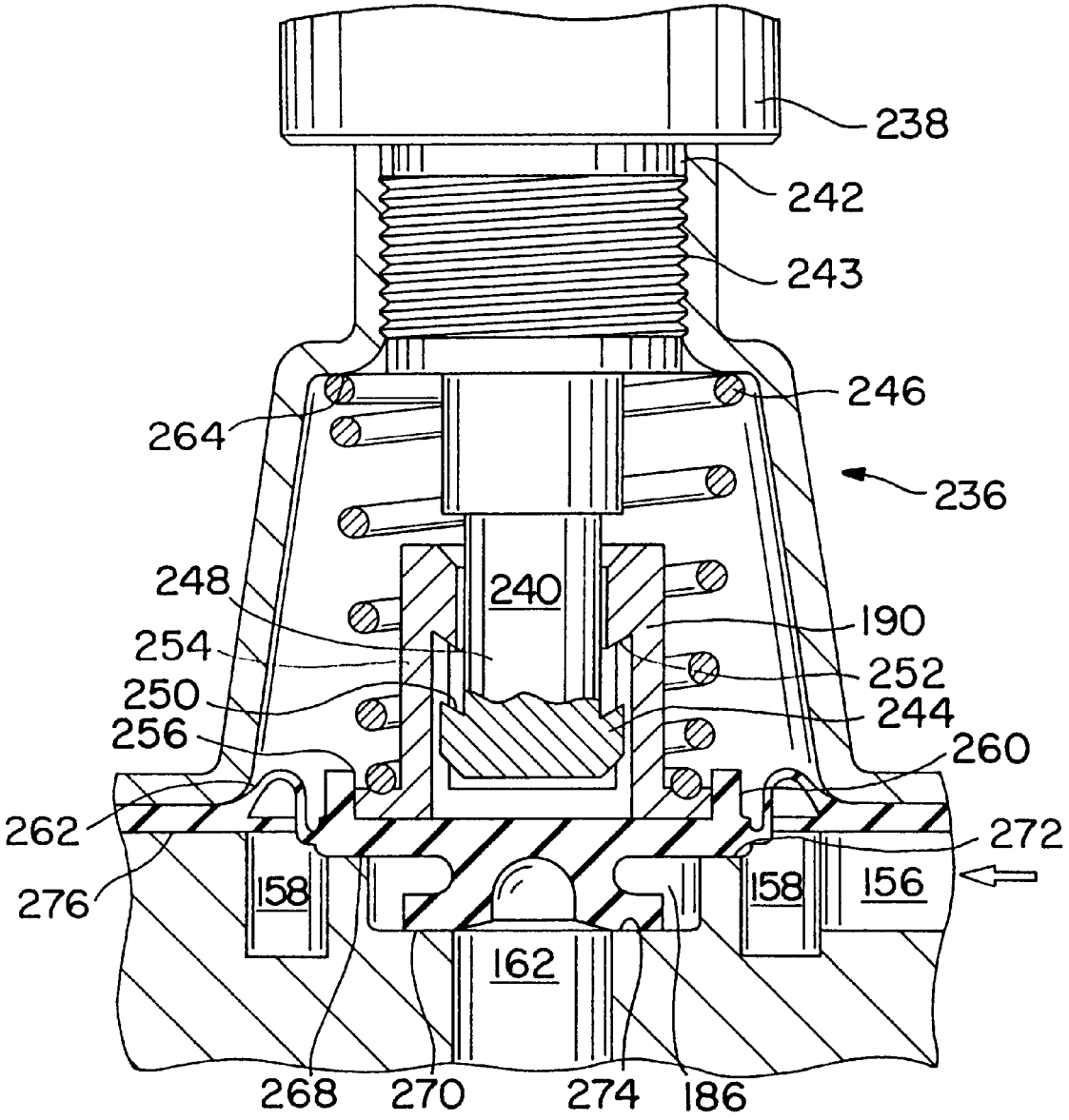
FIG. 10 is a cross-sectional view of a valve assembly of the novel gas control unit.

Referring to FIG. 10, the gas control unit also includes valve means 236 which operates to open and close passages openings 162 and 164, which lead to the oven gas outlets 168 and 170, respectively. The unit also includes a means for moving the valve means 236 between the respective open and close positions. This moving means may be driven by a variety of energy sources, such as mechanical, pneumatic or electrical. According to a preferred embodiment illustrated in the figures, the valve moving means is in the form of an electrical solenoid 238. The solenoid is in threaded engagement with opening 242 of the cover. The valve moving means further includes a plunger 240, which is received by the solenoid. More particularly, in the embodiment illustrated in FIG. 10, the proximal end of the plunger 240 passes internally through the threaded region 243 of the solenoid. The distal end 244 of the plunger is received and retained by valve carrier 190, which is, in turn, matingly engaged by the sealing diaphragm 138 as previously discussed. Positioned between the sealing diaphragm and the cover and encircling the plunger and the valve carrier is a spring 246.

According to a preferred embodiment, the distal portion of the plunger includes an intermediate segment 248 having a diameter smaller than the remainder of the plunger. The intermediate and distal portions of the plunger meet in a manner to create a shoulder 250 on the proximal end of the distal portion. In operation the shoulder 250 engages a mating inwardly extending surface 252 of the valve carrier 190.

In a preferred embodiment, the valve carrier comprises three upstanding appendages. The appendages have three main sections. First, the proximal ends of the appendages are the inwardly extending surfaces 252, which as described above, engage the shoulders of the plunger. Second, the appendages include longitudinally extending shafts 254 extending from the surfaces 252 and terminating in the third main section, i.e., base 256, which is attached to the sealing diaphragm 138. The base 256 and the diaphragm 138 may be attached to one another in a variety of ways. For example, the base may be adhered to the diaphragm. Alternatively, an interference fit may be created between the base and the diaphragm. In addition, the base may be staked or threaded to the diaphragm. Other connections will be obvious to a person skilled in the art.

Additionally, as depicted in both FIGS. 7 and 10, the flexible sheet 182 of the integral diaphragm and seal may include means for positioning and receiving the valve carrier 190. In the embodiment of FIG. 7, the flexible sheet 182 forms an annular shoulder 258 which is internally contiguous with the base 256 of the carrier 190. In contrast, in the embodiment of FIG. 10, the flexible sheet includes an annular ring 260 positioned within annular shoulder 262. In this embodiment, the annular ring 260 positions and is in abutting relationship with the base of the carrier 190

As mentioned above, the valve spring 246 is housed between the cover 140 and the diaphragm 138. As depicted in FIG. 10, after defining the opening 242, the cover extends laterally and then in an downward outwardly tapering manner to provide a shoulder 264, which receives one end of the spring. The other end of the spring 246 is received in annular depression 266 in the base (see FIG. 7).

The valve means, as depicted in FIG. 10, also incorporates a unique valving design in the form of the sealing diaphragm profile. Specifically, the diaphragm 138 utilizes a membrane-type valve disk 186, which has two sealing faces 268 and 270. As such, the sealing faces provide the valve with sealing redundancy. The first sealing face 268 is dimensioned to act against an integral raised annular seat area 272 of the body 136. The second sealing face 270 is dimensioned to act against a second surface 274 of the body. Furthermore, the diaphragm portion 276 extending from the first sealing face 268 acts as a gasket to retain the controlled fluid within the valve. Similar constructions are utilized for both valve means utilized by the described preferred embodiment. The illustrated valving assembly is described in more detail in U.S. patent application Ser. No. 08/562018, entitled "Valving Assembly, " filed Nov. 22, 1995, the disclosure of which is hereby incorporated by reference.

Other valve means may be utilized. For example, if a sealing diaphragm is not used, a valve disk with a tiered profile, which presents two sealing faces may be used. Also, a flat-faced valve disk may be utilized. In either case, the valve should incorporate a separate gasket to retain the controlled fluid within the valve.

Figure 11:
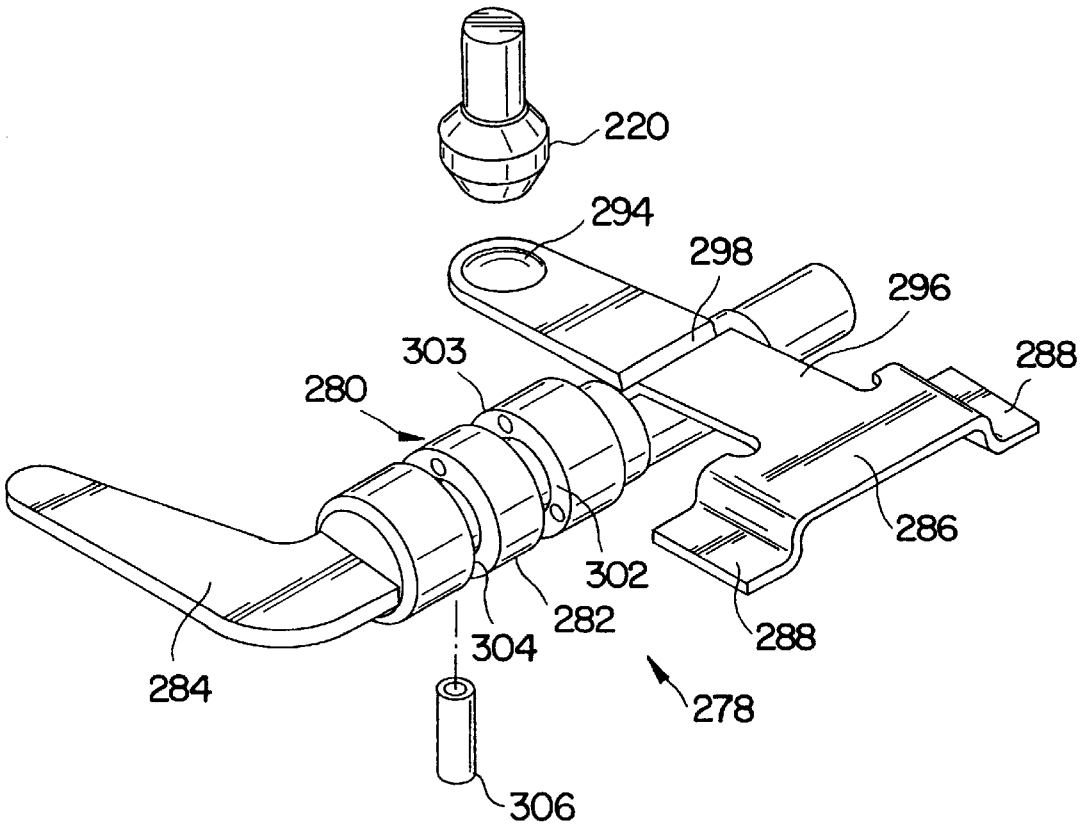
FIG. 11 is a schematic view of the safety valve assembly of the novel gas control unit.
Figure 12:
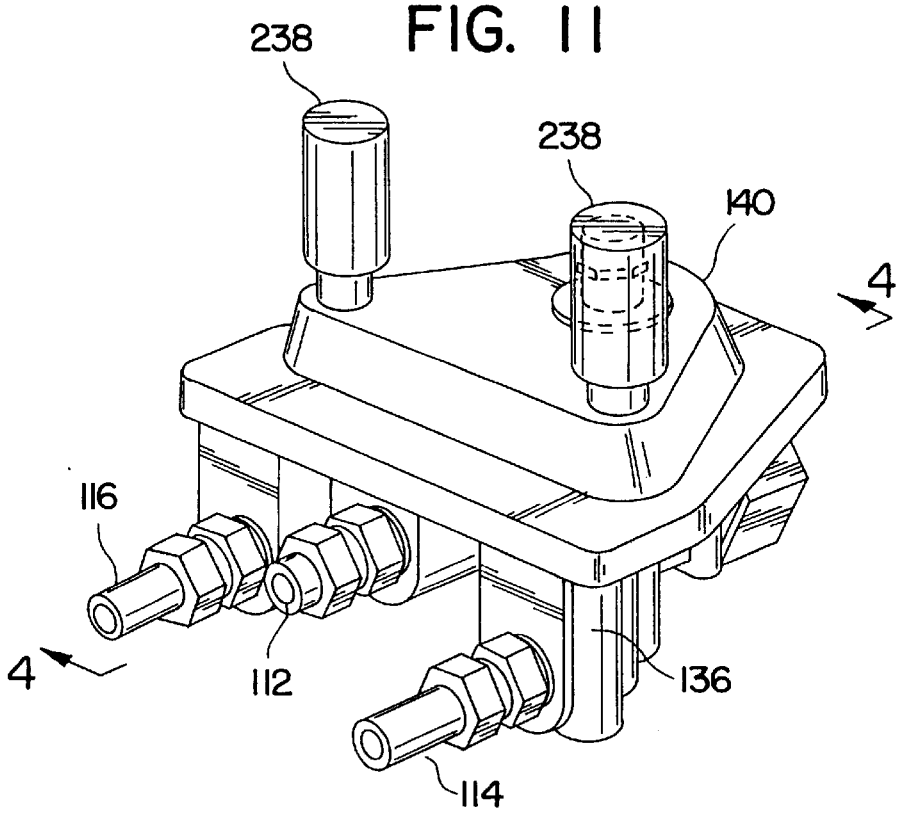
FIG. 12 is a perspective view of the instant novel gas control unit.

Referring to FIGS. 11 and 12, the novel gas control unit also includes a unique manual shut-off configuration. The shut-off, generally referred to as 278, includes lever 280, which comprises a shaft 282 and handle 284. In a preferred embodiment, the handle 284 is positioned outboard of the gas control unit so that it can be manually controlled without any disassembly of the unit. According to this embodiment, the shaft 282 extends from the outboard handle internally into the passageway 142. The lever operatively engages a flap 286. The flap has legs 288 that fit into longitudinal slots 290 in the gas inlet flowpath 142 (see FIG. 4). The slots include shoulders 292 which act as stops to position the flap in the flowpath relative to the regulator stem ball 220. More specifically, the slots are cast or machined longitudinally, as necessary, into the walls of the gas passageway. The slots terminate and internal shoulders are formed at the ends of the slots to position the legs 288 of the flap and, thus the flap itself, in operative relation to the lever 280. The flap 286 also includes a hemispherical protrusion 294 which receives and acts against the stem ball 220. The flap extends along a tongue portion 296 that connects the legs 288 and the protrusion 294. The tongue includes a protrusion 298 that is received by mating detents (not shown) positioned about the lever shaft 282. Depending upon design, two or more detents may be included and these detents may be positioned at various locations about the shaft. The shaft 282 in the area of the flap is elliptical in shape. As will be discussed in more detail below, the rotation of the lever 280 in a manner so as to move from the low cam surface to the high cam surface lifts the shaft protrusion in engaging and lifting relation to the regulator stem to manually close the regulator valve.

The tongue portion 296 of the shut-off assembly 278 limits the downward travel of regulator stem 192 thereby preventing excessive stress on diaphragm 176. Furthermore, when shut-off assembly 278 is in the shut-off position, the tongue prevents movement of regulator stem 192, thereby preventing movement of any regulator parts during shipping. In addition, the shut-off assembly, and particularly the tongue thereof, are dimensioned to avoid the application of excessive force against the ball member 220 and thus avoid deformation of the ball member in respect to the regulator seat 216.

The lever 280 further includes a circumferential recess 302 which may receive a sealing ring 303, such as an o-ring, and partial circumferential recess 304 that can receive a locking pin 306, such as a roll pin, that locks the lever in position in relation to the unit and to stop rotation of the shaft in the desired position.

FIG. 12 illustrates the gas control unit of the present invention as assembled. The figure depicts the mating of the cover 140 with the body 136. It also shows the solenoids 238 in operative engagement with the cover. Also shown are gas outlets 112, 114 and 116 leading from the body to the burner assemblies (not shown).

Figure 14:
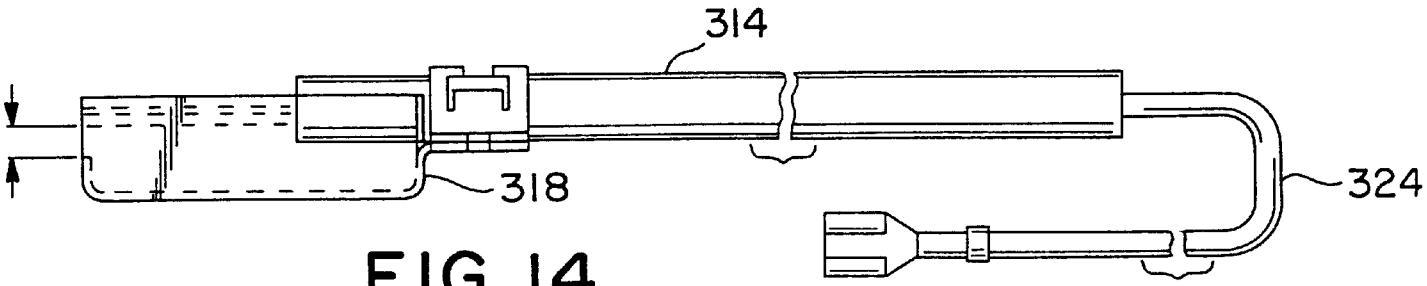
FIG. 14 is a side plan view of the ignitor of FIG. 13.
Figure 13:
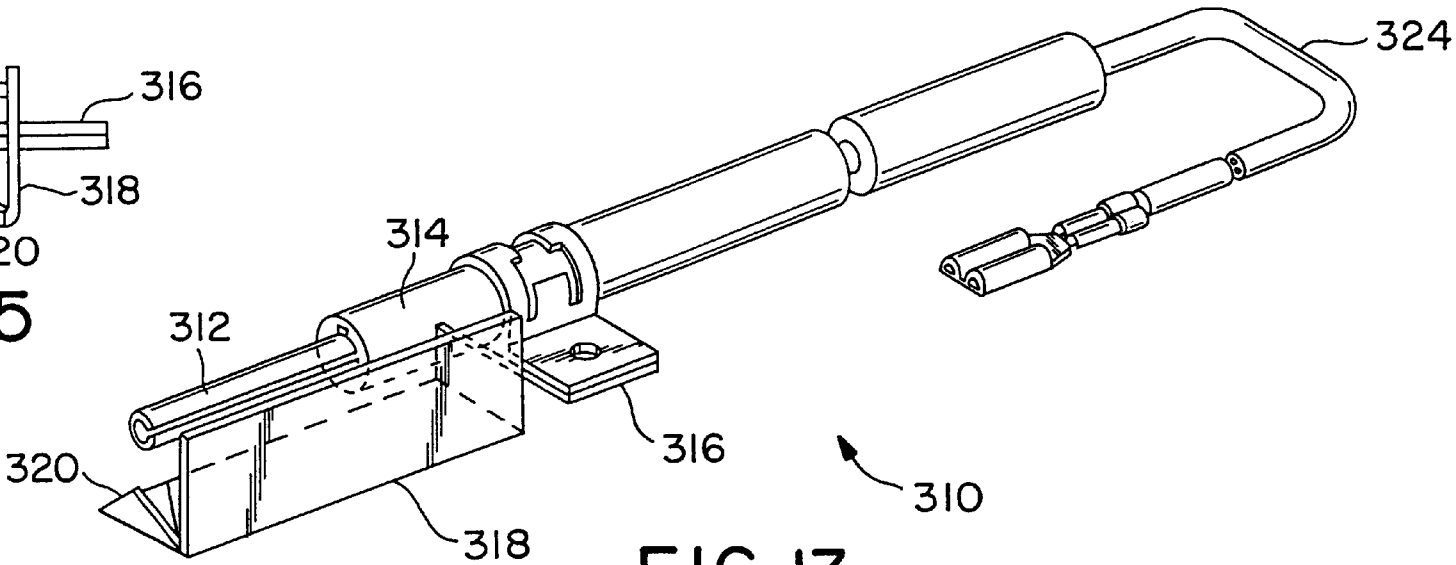
FIG. 13 is a perspective view of a direct spark ignitor of the inventive fluid control assembly.
Figure 15:
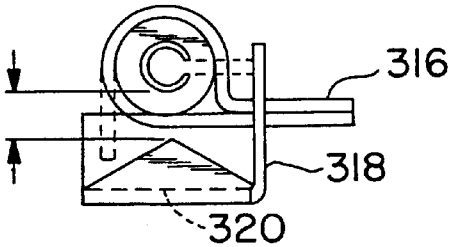
FIG. 15 is an end plan view of the ignitor of FIG. 13.

A preferred spark ignitor of the novel gas control assembly of the present invention is illustrated in FIGS. 13–15. The ignitor 310 generally comprises an electrode portion 312 surrounded by an electrical insulator 314. The insulator 314 is retained by a bracket 316. An electrically conductive spark trap 318 is in electrical conduction with bracket 316. Discharge structure 320 is in electrical conduction with spark trap 318. The discharge structure, spark trap and bracket can be manufactured as one or more electrically conductive components. The spark trap 318 may be provided with one or more slots. An electrically conductive wire 324 provides electrical current to the electrode 312.

The order of assembly of the novel fluid control assembly can vary as will be obvious to one of ordinary skill in the art. An example of such assembly is set out below. First, manual shut-off valve assembly 278 is positioned within the body 136. This is accomplished by sliding the flap 286 longitudinally in slots 290 along the gas inlet passageway 142 until the flap legs 288 abut the shoulders 292 of the slots. The legs are then staked or otherwise retained in abutting relation to the shoulders. The lever 280 is then inserted laterally through an opening in the wall of the unit (not shown) until the cam area of the shaft is positioned relative to the protrusion area 298 of the flap. So positioned, the hemispherical protrusion 294 of the flap is in operative alignment with the ball 220 of the regulator stem 192. So positioned, an o-ring 303, which is positioned in the annular groove 302, prevents gas leaking from the interior of the unit. To secure the lever positioning, the locking pin 306 is inserted into the circumferential recess 304 in the body housing.

With the manual shut-off valve assembly so positioned, the regulator assembly is installed. The regulator seat 216 is securely positioned in the offset pocket 218 of the body. This is accomplished in a variety of manners. For example, the seat may be bonded adhesively to the pocket, staked mechanically to the pocket or otherwise mechanically fastened to the pocket. The ball member 220 is attached to the stem 192 and inserted through the regulator seat.

The opposite end of the stem 192 is then matingly engaged with the pedestal portion 222 (see FIG. 8) of the sealing diaphragm. This engagement may be accomplished in a variety of ways. In the preferred embodiment of the present invention, the pedestal portion of the sheet 182 is physically profiled to receive and secure the end of the stem 192. The stiffener plate 194 is then introduced to the opposing side of the diaphragm in the diaphragm area 176 and particularly with opening 196 receiving the pedestal portion 222 of the diaphragm. Preferably, the back plate 184 is prefabricated with the flexible sheet 182 to produce the integral sealing diaphragm structure of FIG. 9.

Once the regulator stem is connected to the sealing diaphragm, assembly then focuses on the valving areas 178 of sealing diaphragm. The valve carriers 190 are positioned in the valve areas 178 of the sealing diaphragm. As previously mentioned, the valve carriers may be securely positioned relative to the diaphragm in a variety of ways. A preferred means is by adhering the carrier to the diaphragm.

Referring to FIG. 3 again, after the valve carriers are secured, a variety of springs are assembled. First, regulator spring 212 is introduced. Then, springs 246 are positioned about valve carriers 190 in the valve areas 178. Preferably, the springs are positioned relative to the carriers by the annular detents 266 in the carrier base 256. The other end of the spring is positioned by the lateral shoulder 264 of the cover.

As previously noted, the valve carriers 190 preferably comprise an annular base 256 from which multiple appendages extend longitudinally relative to the valve action. These appendages include the internally extending surfaces 252. So constructed, each of the valve carriers receives a plunger 240. The plunger may be introduced by carefully inserting the end 244 of the plunger in a male to female fashion into the appendages of the valve carriers. The appendages are sufficiently flexible to allow such physical insertion. So assembled, the shoulder 250 of the plunger operatively engages the surfaces 252 of the appendages. Preferably, the shoulder and surfaces are angled in mirrored relation to each other as shown in FIG. 10.

At this juncture, the sealing diaphragm is aligned with the body. Particularly, the raised portions 204 and 205 of the sealing diaphragm are mated with the body grooves 172 and 174, respectively, to effect a seal of the assembly against fluid leakage, The engagement of raised portion 204 and groove 172 effect a seal around the valving areas 178. The engagement of raised portion 205 and groove 174 effect a seal around the diaphragm area 176.

The cover 140 and parts external to the cover now may be assembled. The cover is first brought into alignment with the body and sealing diaphragm and particularly with the regulator springs, valving springs and plungers so as to engage same in the manner described above. Thereafter, solenoids 238 are threadedly engaged in openings 242 of the cover. So engaged, the solenoids receive the plungers 240. The spring 214 is introduced through opening 228 of the cover 140. The spring is retained within the spring 212 and between the diaphragm and cover. The cap 233 is slid onto the exterior surface of opening 228 and the plug 226 is threadedly engaged in the opening. The plug 226 secures the cap 233. As previously noted, the determination of which way the plug will be inserted into the cover opening depends upon the gas passing through the unit. For example, if natural gas is utilized, the short end 230 is inserted. If other gas is utilized or if additional force is needed, the long end 232 is inserted. In the latter case, the exposed face of the long end of the plug engages the spring 214.

The cover 140 is then forced into contact with the outer periphery 193 of the sealing diaphragm 138 to compressively load the periphery. Thereafter, the tabs 235 are turned inwardly about the periphery of the body. While tabs 235 are preferred, other attachment means are possible, including rivets, machine screws or other mechanical fasteners. After crimping or other cover assembly operation, the compressive load upon sealing diaphragm 138 will serve to keep the assembly secure.

Once the unit is so assembled, the gas inlet 101 is connected to a gas inlet supply means (not shown). The gas outlets 150, 168 and 170 are connected to gas outlet lines 112, 116 and 114, respectively. Outlet line 112 is connected to manifold 118 for supplying gas to range top burner assemblies 120. Outlet line 114 is connected to broil burner assembly 122, and outlet line 116 is connected to bake burner assembly 124. The solenoids 238 are electrically connected to electronic range control 129. The control 129, in turn, is connected to an input means 127, such as a knob. The control 129 is also electrically connected to spark module 131 which is electrically connected to the terminal wire 133 of the direct spark ignitor. Finally, the control 129 is connected to a temperature sensor 125.

In operation, the fluid control assembly provides fluid pressure regulation, operational fluid valving, manual shut-off valving and automatic fluid safety shut-off valving. Referring first to FIG. 4, the inlet fluid, as provided by an outside source, is delivered to the unit at fluid inlet 101. The unregulated fluid passes into and through passageway 142 to opening 144 in the body 136. In the open position, the lever handle is turned to a position wherein the low side of the cam surface engages the flap 296. Particularly, the protrusion of the flap matingly engages the detent of the shaft (cam low side). The mating engagement helps to prevent unwanted rotation of the shaft, possibly as a result of vibration, which would result in the bias of the flap toward the closed position.

With the manual shut-off valve positioned in this open position, the unregulated fluid passes through opening 144 into the regulating chamber 145. The chamber is sealed circumferentially by the mating engagement of the raised portion 205 of the sealing diaphragm and the groove 174 of the body. The fluid is then regulated by the action of the diaphragm area 176 of the sealing diaphragm 138 in concert with the fluid regulating assembly 210.

As mentioned above, the exact operation of the assembly 210 depends upon the type of fluid delivered to the unit. If natural gas is delivered, only spring 212 is biased by the cover 140 and, likewise, against diaphragm area 176 to present a constant regulating pressure to the pressure regulating chamber. In contrast, if liquified petroleum gas, for example, is supplied to the unit, the plug 226 is inserted with its long end 232 in engagement with spring 214. So biased, the spring 214 adds additional pressure to the diaphragm area 176.

Thus regulated, the fluid exits the regulating chamber 145 via opening 146 and into passageway 148. Passageway 148 leads to two different locations. On the one hand, the passageway leads to fluid outlet 150 which connects to fluid outlet line 112. Fluid outlet line 112 provides gas to the range-top burners. On the other hand, passageway 148 connects to a passageway 154 which leads to opening 152 in the valving area. This latter routing of the gas provides gas to be valved to the oven burner assemblies.

More specifically, and referring now to FIG. 5, the regulated gas exits opening 152 and passes into opposing channels 156. The chambers are formed by the combination of recesses in the body and the sealing diaphragm as a top cover. The gas passes along channels 156 and into annular chambers 158 and 160 in the respective valving areas 178.

Referring now to FIG. 10, one valving area is shown, with the understanding that the other valving area is similarly constructed and operates similarly. In operation, a user of the fluid control assembly, in the preferred embodiment a gas oven and range, utilizes the input means 127 to establish the desired oven operating conditions, including the selection of bake or broil functions. Input means 127 electrically communicates with electronic range control 129 which, in turn, sends appropriate electrical signals to spark module 131.

The spark module sends electrical energy to the appropriate direct spark ignitor 310, this energy being of sufficient voltage to cause sparking to occur between electrode 312 and discharge portion 320. Electronic range control 129 will also supply electrical energy to the appropriate solenoid whereby valving means will be opened to send gas to the desired burner. Particularly, once a current is introduced to the solenoid so as to signal an open condition, the plunger 240 is lifted by the solenoid. Because of the initial distance between the shoulder 250 of the plunger and the surfaces 252 of the fingers, the plunger gains momentum as it is lifted and transfers the momentum as necessary to the valve carrier 190 to disengage the valve disc 186 from the sealing seats 272 and 274. Once separation of the valve disk and seats is obtained, the valve carrier acts against the spring force to open the valve and allow gas to flow from channel 158 over annular shoulder 268 and into opening 162. As is apparent, the sealing diaphragm in areas 178 acts to seal the valve areas from leakage of the gas laterally from channels 158 and 160. This sealing ability is reinforced by the cover assembly construction and the back plate in the area radially outwardly of the valve area 178.

As gas flows through opening 162, it continues along passageway 166 (see FIG. 4). A similar opening and passageway exists for the other valve means. The passageway connects opening 162 with the gas outlet 168. Similarly, the other passageway connects to gas outlet 170. The gas passes through the particular outlet line to the selected oven burner assembly where it is ignited by the spark from direct spark ignitor 310. The electronic range control and the spark module will electrically sense the flame presence, i.e., a current flow path, through the direct spark ignitor and thereby continue to supply electrical energy to the appropriate solenoid thus continuing the supply of fuel. In the event of loss of flame, the electronic control and spark module through the direct spark ignitor will sense the loss of flame and discontinue the electrical energy to the appropriate solenoid, thereby shutting off the supply of fuel to the burner. This flame sensing capability provides the present gas control assembly with the necessary automatic safety shut-off valving feature.

The L-shaped spark trap 318 provides for collection of gas from the burner assembly to increase the likelihood that the gas will ignite and that a flame will result. The unique ignitor design also avoids providing a direct spark to the burner. In this latter case, the flame may lift off the burner and as such the controls do not sense a flame, i.e., no current path is provided, and the control shuts gas off. Instead, by providing a spark between the electrode 312 and the discharge structure 320, the lifting flame situation is avoided.

When the temperature in the oven cavity reaches the value set by the input means, temperature sensing means 125 causes the electronic range control to discontinue the electrical energy to the appropriate solenoid, thereby shutting-off fuel to the respective burner and extinguishing the flame. When the temperature sensing means 336 senses that the temperature of the oven cavity has fallen below the set temperature, the heating cycle is repeated.

In the event of a failure or if other repairs are necessary, the manual shut-off valve may be manually operated to close all gas flow to the assembly. In particular, the handle 284 of the lever 280 is rotated until the high side of the cam acts against the flap to bias the flap upwardly and thus to engage the ball of the regulator stem. Upon rotation of the lever to the high side of the cam, the detent in the shaft engages the flap protrusion 298 to lock the flap in the raised position. In this raised position, the flap lifts the ball member to engagement with regulator seat to close opening 144 to gas flow. Once the unit is ready for continued use, the lever is returned to its original position and the regulator stem lowers to open the unit to gas flow.

According to the embodiment described above, the inventive fluid control assembly involves a gas range and oven assembly. It will be appreciated that the fluid control assembly is not limited to the described application but, instead, may be used in a variety of applications that require a fluid to be pressure regulated and valved and that require manual shut-off and automatic safety shut-off capabilities, or a combination thereof. Such applications include any heating appliance, laundry equipment, and any fluid dispensing machines, such as vending machines. In addition, the above-described preferred embodiment may assume various structures. For example, only one oven gas outlet may be utilized to provide gas to a single burner oven.

The body 136 may be manufactured utilizing a variety of materials and techniques. For example, the body may be made from any suitable material that will withstand the particular operational environment. In the case of a gas oven and range assembly, the material must be able to withstand the significantly high temperatures to which the assembly will be exposed. In the case of a gas range and oven, a preferred material is die cast aluminum.

The flexible sheet 182 may be made from a variety of materials that offer sufficient flexibility. For example, a variety of elastomeric materials are suitable for use. Particularly preferred is silicone rubber. The stiffener 194 is selected from a material having resistance to deformation greater than the flexible sheet. While numerous materials meet this requirement, particularly preferred is stamped sheet metal. Finally, the back plate 184 is selected from a variety of materials that provide the sealing diaphragm with dimensional stability and increased rigidity. Preferred materials include plated steel and stainless steel.

The regulator seat and stem may be constructed from a variety of materials. The critical consideration is that the ball member of the stem and the regulator seat be selected from materials that provide a sufficient sealing capacity. The springs may be manufactured from a variety of well-known materials. The cover may be constructed from a variety of materials that can be formed into the necessary shape. A preferred material of construction is stamped plated steel. Also applicable are cast aluminum and stainless steel. The components of the direct spark ignitor may be produced from a variety of well-known materials that exhibit the required electrical characteristics.

Hence, as is apparent, the instant fluid control assembly integrates numerous functions in one assembly. As such, it avoids the numerous separate subassemblies currently needed to achieve these same ends. It also avoids the necessity of acquiring and assembling the many independent parts currently required to build these subassemblies and the resulting possibility of fluid leakage. Such simplification means that the manufacturers of various fluid control devices can acquire one integral unit, attach it to requisite fluid inlet(s) and outlet(s), adjust the unit for the type of fluid supplied, and provide valving control to the unit and, thus, accomplish what currently requires numerous subassemblies, numerous parts and significant labor.

The present invention, therefore, is well-adapted to carry out the objects and attain the ends and advantages mentioned, as well as others inherent therein. While presently preferred embodiments of the invention have been given for the purpose of disclosure, numerous changes in the details of construction, arrangement of parts, and steps of the process, may be made which will readily suggest themselves to those skilled in the art and which are encompassed within the spirit of the invention and the scope of the appended claims.

What is claimed is:

1. A fluid control unit, comprising:

a body which includes a multiplicity of fluid passageways, a fluid inlet, at least one valve seat, a fluid outlet and a fluid pressure regulating chamber;

an integral diaphragm and seal member which includes a diaphragm area that is positionable in relation to said fluid pressure regulating chamber to regulate fluid pressure of fluid flow through said fluid control unit, a valving area that is engageable with said at least one valve seat of said body, and a fluid sealing area, said integral diaphragm and seal member being positioned in operative engagement with said body; and a cover positioned on a side of said integral diaphragm and seal member opposite said body, wherein said body, said integral diaphragm and seal member, and said cover are joined together to form an operative unit.

2. The fluid control unit of claim 1, further comprising a spring biasly engaging said diaphragm area to position said diaphragm area relative to said regulating chamber to regulate fluid pressure of fluid flow through said fluid control unit.

3. The fluid control unit of claim 2, wherein said spring is disposed adjacent said cover and adjacent said diaphragm area.

4. The fluid control unit of claim 2, further comprising a fluid pressure regulating assembly including said spring and a regulator stem projecting forwardly into said regulating chamber from adjacent said diaphragm area and engageable with a regulator valve seat to restrict fluid flow through said fluid control unit.

5. The fluid control unit of claim 4, further comprising a manual shut-off that is actuable to position said regulating stem in engagement with said regulator valve seat to shut off fluid flow through said fluid control unit.

6. The fluid control unit of claim 4, wherein said regulator stem includes a distal end and a proximal end adjacent said diaphragm area, said regulator stem further including a ball member disposed at said distal end that is engageable with said regulator valve seat to restrict fluid flow.

7. The fluid control unit of claim 1, wherein said valving area comprises dual valve disks and a valve sealing web.

8. The fluid control unit of claim 1, wherein said diaphragm member comprises a flexible sheet, a backup plate and a stiffener plate, said stiffener plate being positioned adjacent said flexible sheet in an area of said regulating chamber.

9. The fluid control unit of claim 1, further comprising a manual shut-off for manually shutting off fluid flow.

10. The fluid control unit of claim 1, further comprising a solenoid operable to engage and disengage said valving area of said integral member with said at least one valve seat of said body.

11. The fluid control unit of claim 1, wherein said diaphragm area is structurally distinct from said valving area, and said valving area is structurally distinct from said sealing area.

12. A fluid control unit, comprising:

a body which includes a multiplicity of fluid passageways, a fluid inlet, at least one valve seat, a fluid outlet and a fluid pressure regulating chamber;

an integral diaphragm and seal member which includes a diaphragm area positionable in relation to said fluid pressure regulating chamber to regulate fluid pressure of fluid flow through said fluid control unit, a valving area engageable with said at least one valve seat of said body and a fluid sealing area, said integral diaphragm and seal member being positioned in operative engagement with said body;

a cover positioned on a side of said integral diaphragm and seal member opposite said body, wherein said body, said integral diaphragm and seal member, and said cover are joined together to form an operative unit;

a fluid pressure regulating assembly including a spring biasly engaging said diaphragm area to position said diaphragm area relative to said regulating chamber to regulate fluid pressure of fluid flow through said fluid control unit and a regulator stem projecting forwardly into said regulating chamber from adjacent said diaphragm area and engageable with a regulator valve seat to restrict fluid flow through said fluid control unit; and a manual shut-off that is actuable to position said regulating stem in engagement with the regulator valve seat to shut off fluid flow through said fluid control unit.

* * * * *